US012673759B2

(12) United States Patent
Kawai

(10) Patent No.: US 12,673,759 B2
(45) Date of Patent: Jul. 7, 2026

(54) HULL ATTITUDE CONTROL APPARATUS

(71) Applicant: HONDA MOTOR CO., LTD., Tokyo (JP)

(72) Inventor: Norikazu Kawai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 814 days.

(21) Appl. No.: 17/940,017

(22) Filed: Sep. 8, 2022

(65) Prior Publication Data

US 2024/0083567 A1 Mar. 14, 2024

(51) Int. Cl.

| | |
|---|---|
| ***B63H 20/10*** | (2006.01) |
| ***B63B 39/00*** | (2006.01) |
| *B63H 20/12* | (2006.01) |

(52) U.S. Cl.

CPC ..... *B63H 20/10* (2013.01); *B63B 39/005* (2013.01); *B63H 20/12* (2013.01)

(58) Field of Classification Search

CPC ..... B63H 20/10; B63H 20/12; B63H 25/42; B63B 39/005

See application file for complete search history.

(56) References Cited

U.S. PATENT DOCUMENTS

2023/0373607 A1* 11/2023 Hamada ..... B63H 20/12

FOREIGN PATENT DOCUMENTS

| | | |
|---|---|---|
| JP | 2019-529225 | 10/2019 |
| WO | 2018/055649 | 3/2018 |

* cited by examiner

*Primary Examiner* — Andrew Polay

(74) *Attorney, Agent, or Firm* — Amin, Turocy & Watson, LLP

(57) ABSTRACT

A hull attitude control apparatus (1) includes: an outboard engine (3) that includes a propeller (12) which is provided on a hull (2) and generates a thrust force at the hull (2) and a propeller drive motor (9) which drives the propeller (12); an attitude control portion (4) that controls an inclination angle of a propeller rotation axis line (S2); an outboard engine control portion (20) that performs a drive control of the propeller drive motor (9); and a shake detection sensor that detects a shake of the hull (2). The attitude control portion (4) and the outboard engine control portion (20) perform a drive control of the propeller (12) so as to prevent shaking of the hull (2) based on a detection result of the shake detection sensor.

31 Claims, 7 Drawing Sheets

HULL ATTITUDE CONTROL APPARATUS

BACKGROUND OF THE INVENTION

Field of the Invention

The present invention relates to a hull attitude control apparatus.

Background Art

In the related art, various techniques have been proposed that prevent a hull from shaking or moving at the time of anchorage. For example, a technique is disclosed in which a stabilization fin is provided on the hull (for example, refer to Patent Document 1 (Published Japanese Translation No. 2019-529225 of the PCT International Publication)).

In this technique, when the hull begins to shake, the stabilization fin is operated. Thereby, a force that acts on the hull cancels a force in the shake direction of the hull, and it is possible to prevent shaking of the hull.

SUMMARY OF THE INVENTION

However, in the related art described above, there is a problem that since it is necessary to provide the stabilization fin in order to prevent shaking of the hull, manufacturing costs and the weight of the hull are increased. There is a problem that even in the case of preventing the movement of the hull, it is necessary to provide an additional mechanism. As a result, there is a problem that it is difficult to improve the energy efficiency for ensuring access to sustainable and advanced energy.

Accordingly, the present invention provides a hull attitude control apparatus that can prevent shaking or the movement of the hull and can contribute to the improvement of the energy efficiency while minimizing the increase of manufacturing costs and the weight as much as possible.

In order to solve the problems described above, the present invention proposes the following means.

(1) A hull attitude control apparatus (for example, a hull attitude control apparatus 1 of an embodiment) according to the present invention includes: an outboard engine (for example, an outboard engine 3 of the embodiment) that includes a propeller (for example, a propeller 12 of the embodiment) which is provided on a hull (for example, a hull 2 of the embodiment) and generates a thrust force at the hull and an electric motor (for example, a propeller drive motor 9 of the embodiment) which drives the propeller; an inclination angle control portion (for example, an attitude control portion 4 of the embodiment) that controls an inclination angle of a propeller rotation axis line (for example, a propeller rotation axis line S2 of the embodiment) in the propeller; a motor control portion (for example, an outboard engine control portion 20 of the embodiment) that performs a drive control of the electric motor; and a state detection sensor (for example, a shake detection sensor 19 of the embodiment) that detects or predicts at least one of a shake and a movement of the hull, wherein the angle control portion and the motor control portion perform a drive control of the propeller so as to prevent at least one of the shake and the movement of the hull based on a detection result or a prediction result of the state detection sensor.

By such a configuration, it is possible to prevent shaking or the movement of the hull by the thrust force of the propeller of the outboard engine. Therefore, an additional mechanism for preventing shaking or movement of the hull as in the related art is not required, and it is possible to prevent shaking of the hull while minimizing the increase of manufacturing costs and the weight of the hull attitude control apparatus as much as possible. By preventing shaking of the hull, it is also possible to prevent the movement of the hull at the time of anchorage.

Since it is possible to minimize the increase of manufacturing costs and the weight of the hull attitude control apparatus as much as possible, it is possible to contribute to the improvement of the energy efficiency.

(2) In the configuration described above, the motor control portion may perform the drive control of the propeller in the state where the propeller rotation axis line is inclined relative to a horizontal direction by the inclination angle control portion.

By such a configuration, particularly when shaking of the hull is prevented, the direction of the thrust force generated by the propeller can be close to an upward-downward direction. Therefore, shaking of the hull is easily prevented.

(3) In the configuration described above, the motor control portion may perform the drive control of the electric motor so as to generate the thrust force in a direction opposite to a shake direction or a movement direction of the hull.

By such a configuration, it is possible to reliably and efficiently prevent shaking or the movement of the hull, and it is possible to contribute to the improvement of the energy efficiency.

(4) In the configuration described above, the motor control portion may change the thrust force in accordance with a shake speed or a movement speed of the hull.

By such a configuration, it is possible to quickly prevent shaking or the movement of the hull.

(5) In the configuration described above, the state detection sensor may detect or predict shaking of the hull, and the motor control portion may repeatedly rotate the electric motor forward and backward in accordance with shaking of the hull.

By such a configuration, it is possible to further quickly and continuously prevent shaking of the hull.

(6) In the configuration described above, the state detection sensor may detect or predict the movement of the hull, and in an anchorage state of the hull, the inclination angle control portion and the motor control portion may rotate the electric motor forward and backward so as to generate a thrust force in a direction opposite to a movement direction of the hull, and the motor control portion may determine the drive time of the electric motor so as to stop the hull at a place.

By such a configuration, it is possible to effectively prevent the movement of the hull at the time of anchorage, and it is possible to contribute to the improvement of the energy efficiency.

(7) In the configuration described above, the outboard engine may include, at a tilt-down position (for example, a tilt-down position TDp of the embodiment), an upper unit (for example, an upper unit 5 of the embodiment) on which the electric motor is provided and which is arranged at an upper portion and a lower unit (for example, a lower unit 6 of the embodiment) on which the propeller is provided and which is arranged at a lower portion of the upper unit, the lower unit may be provided to be rotatable relative to the upper unit around a lower unit rotation axis line (for example, a lower unit rotation axis line S1 of the embodiment) that is in parallel with an alignment direction of the upper unit and the lower unit, and a thrust force may be generated in a direction opposite to a movement direction of the hull by rotating the lower unit relative to the upper unit.

By such a configuration, the operation of the outboard engine is decreased as much as possible, it is possible to efficiently prevent the movement of the hull at the time of anchorage, and it is possible to contribute to the improvement of the energy efficiency.

(8) In the configuration described above, the outboard engine may include, at a tilt-down position, an upper unit on which the electric motor is provided and which is arranged at an upper portion and a lower unit on which the propeller is provided and which is arranged at a lower portion of the upper unit, the lower unit may be provided to be rotatable relative to the upper unit around a lower unit rotation axis line that is in parallel with an alignment direction of the upper unit and the lower unit, the propeller may be provided at the tilt-down position so as to be offset rearward relative to the lower unit rotation axis line, and when the propeller rotation axis line is inclined relative to a horizontal direction by the inclination angle control portion, in a state where the propeller is inverted around the lower unit rotation axis line from an attitude at a time of traveling of the hull, the outboard unit may be inclined to a tilt-up position (for example, a tilt-up position TUp of the embodiment).

By such a configuration, the tilt-up position can be positioned as high as possible in a range in which the propeller can be submerged in water. When the tilt-up position is positioned as high as possible, the propeller rotation axis line can be aligned along the upward-downward direction as much as possible. That is, the thrust force generated by the propeller can be aligned along the upward-downward direction as much as possible. As a result, shaking of the hull can be efficiently prevented by the thrust force of the propeller, and it is possible to contribute the improvement of the energy efficiency.

(9) In the configuration described above, the inclination angle control portion may control an inclination angle of the propeller rotation axis line by controlling a tilt-up angle of the outboard engine.

By such a configuration, the outboard engine can have a simple structure, and it is possible to prevent shaking or the movement of the hull by a simple control.

(10) In the configuration described above, the state detection sensor may include a tilt angle sensor (for example, a shake detection sensor 19 of the embodiment) that is provided on the hull and detects a tilt of the hull, and shaking of the hull may be detected based on a detection result of the tilt angle sensor.

By such a configuration, it is possible to detect shaking of the hull with high accuracy.

(11) In the configuration described above, the state detection sensor may include a distance sensor (for example, a distance sensor 24 of the embodiment) that is provided on the hull and detects the distance from an arrangement position to a water surface (for example, a water surface W of the embodiment), and shaking of the hull may be detected based on a change of the distance detected by the distance sensor.

By such a configuration, it is possible to increase variations of means that detect shaking of the hull.

(12) In the configuration described above, the state detection sensor may include a plurality of buoys (for example, a buoy 25 of the embodiment) that float around the hull and a buoy detection sensor (for example, a buoy detection sensor 26 of the embodiment) that detects a position of each of the plurality of buoys, and the state of a wave around the hull is obtained based on a detection result of the buoy detection sensor, and at least one of the shake and the movement of the hull is predicted based on the obtained state of the wave.

By such a configuration, it is possible to predict shaking of the hull.

(13) In the configuration described above, the state detection sensor may include a wave camera (for example, a wave camera 28 of the embodiment) that images a wave (for example, a wave R of the embodiment) around the hull, and at least one of shake and movement of the hull may be predicted based on the state of the wave imaged by the wave camera.

By such a configuration, it is possible to increase variations of means that detect shaking of the hull.

(14) In the configuration described above, the shake detection sensor may include an object camera (for example, an object camera 29 of the embodiment) that images an object (for example, an object O of the embodiment) around the hull or a horizontal line (for example, a horizontal line H of the embodiment) as a reference, and at least one of the shake and the movement of the hull may be detected based on shaking of the object or the horizontal line imaged by the object camera or a change of the distance to the object.

By such a configuration, it is possible to increase variations of means that detect shaking of the hull.

(15) In the configuration described above, the shake detection sensor may include a small flight vehicle (for example, a small flight vehicle 27 of the embodiment) that detects an attitude of the hull, and at least one of the shake and the movement of the hull may be detected based on a detection result by the small flight vehicle.

By such a configuration, it is possible to increase variations of means that detect shaking of the hull.

Effects of the Invention

According to the present invention, it is possible to prevent shaking or the movement of the hull by the hull attitude control apparatus, and it is possible to contribute to the improvement of the energy efficiency while minimizing the increase of manufacturing costs and the weight of the hull attitude control apparatus as much as possible.

EMBODIMENTS

Next, an embodiment of the present invention will be described with reference to the drawings.

Marine Vessel

Figure 1:
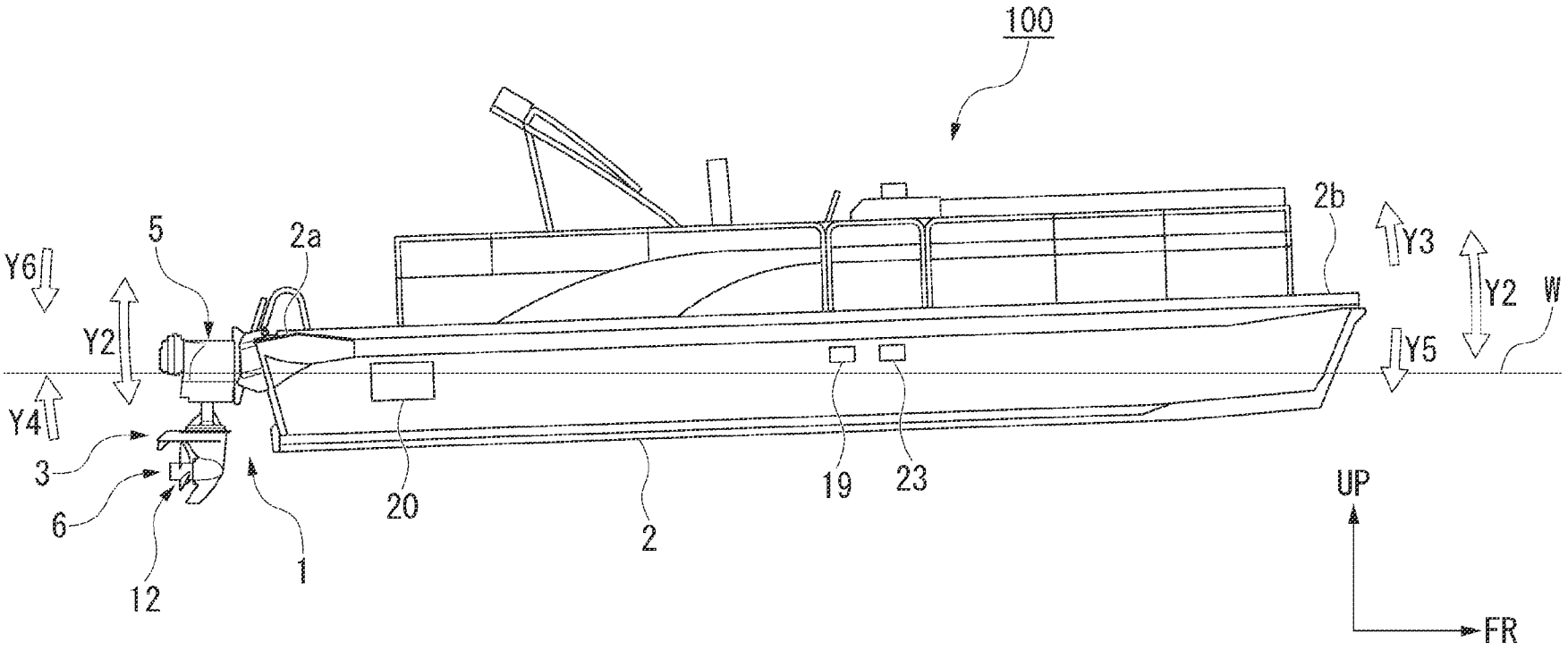
FIG. 1 is a configuration view of a marine vessel according to an embodiment of the present invention.
Figure 2:
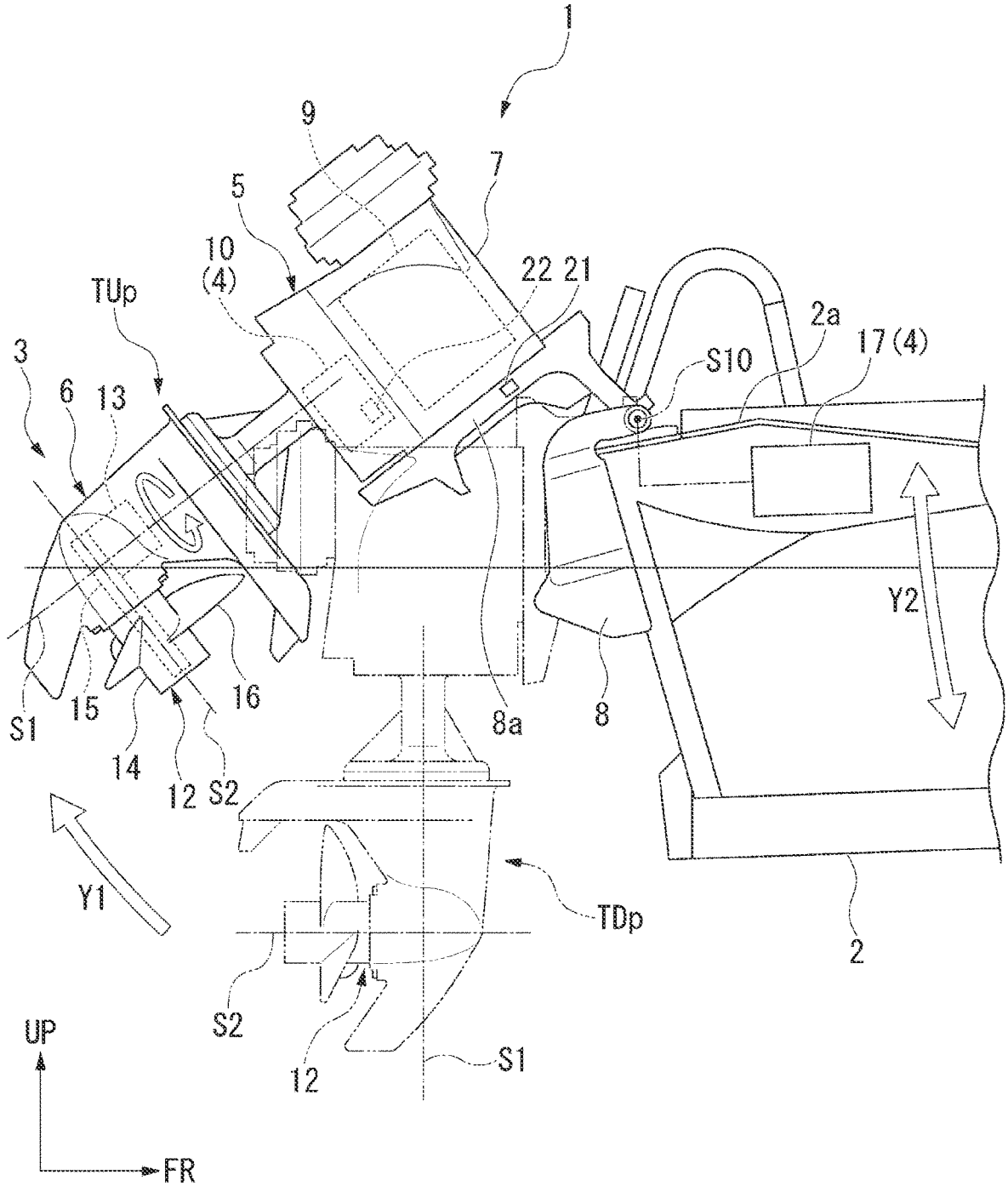
FIG. 2 is an enlarged configuration view of a stern of the marine vessel according to the embodiment of the present invention.

FIG. 1 is a configuration view of a marine vessel 100 on which a hull attitude control apparatus 1 is provided. FIG. 2 is an enlarged configuration view of a stern 2*a* of the marine vessel 100. In the drawings, an arrow FR indicates a forward movement direction (forward direction) of the marine vessel 100. An arrow UP indicates an upward direction of the marine vessel 100. An arrow LH indicates a leftward direction in a hull width direction of the marine vessel 100.

As shown in FIG. 1 and FIG. 2, the marine vessel 100 includes a hull 2 and a hull attitude control apparatus 1 that prevents the shake and the movement at the time of anchorage of the hull 2.

Hull Attitude Control Apparatus

The hull attitude control apparatus 1 includes: an outboard engine 3 that is provided on the stem 2*a* of the hull 2; an attitude control portion 4 that performs an attitude control of the outboard engine 3; a shake detection sensor 19 that detects shaking of the hull 2; and an outboard engine control portion 20 that performs an overall drive control of the outboard engine 3.

Outboard Engine

The outboard engine 3 includes an upper unit 5 that is attached to the hull 2 and a lower unit 6 that is attached to the upper unit 5.

The upper unit 5 includes a cowl 7 that is attached to the stern 2*a* via a bracket 8 so as to be tiltable (tilt-up enabled) in an upward-downward direction. The bracket 8 includes, for example, a base portion 8*a* by which the width direction of the hull 2 is a rotational axis line S10. The upper unit 5 is fixed to the base portion 8*a*.

The upper unit 5 tilts in the upward-downward direction relative to the hull 2 so as to rotate around the rotation axis line S10 of the bracket 8. That is, when the upper unit 5 is located at a lower position (indicated by a two-dot chain line in FIG. 2, hereinafter referred to as a tilt-down position TDp), the upper unit 5 is close to the stern 2*a*.

From this state, when the upper unit 5 is rotated so as to separate from the stern 2*a*, the upper unit 5 is moved upward (refer to an arrow Y1 in FIG. 2, hereinafter may be referred to as tilt-up). In a state where the upper unit 5 is located at an upper position (hereinafter, referred to as a tilt-up position TUp), the upper unit 5 is inclined relative to the tilt-down position TDp. The entire outboard engine 3 is tilted by the tilting of the upper unit 5.

Such tilting of the outboard engine 3 (tilting of the cowl 7) is performed by a hydraulic cylinder 17 and the bracket 8 that constitute part of the attitude control portion 4. The hydraulic cylinder 17 is an actuator that is provided on the hull 2. However, the embodiment is not limited thereto, and the hydraulic cylinder 17 may be provided in the cowl 7 of the upper unit 5. Further, an electric motor may be used instead of the hydraulic cylinder 17. The bracket 8 is driven by the drive of the hydraulic cylinder 17, and the outboard engine 3 is tilted. A detailed configuration of the attitude control portion 4 will be described later.

Further, a propeller drive motor 9 and a head oscillation drive motor 10 are stored in the cowl 7. The propeller drive motor 9 is an electric motor for rotationally driving a propeller 12 described later of the lower unit 6. The head oscillation drive motor 10 constitutes part of the attitude control portion 4. The head oscillation drive motor 10 is an electric motor for rotationally driving a casing 11 (described later) of the lower unit 6. The propeller drive motor 9 and the head oscillation drive motor 10 are tilted integrally with the cowl 7 relative to the hull 2.

The lower unit 6 is provided on a lower portion of the upper unit 5 at the tilt-down position TDp. The lower unit 6 includes, at the tilt-down position TDp, a casing 11 that is provided at a lower portion of the cowl 7 and a propeller 12 that is rotatably supported by the casing 11.

The casing 11 is attached at the tilt-down position TDp rotatably around a lower unit rotation axis line S1 along the upward-downward direction relative to the upper unit 5. Since the upward-downward direction is also an alignment direction of the upper unit 5 and the lower unit 6, the lower unit rotation axis line S1 is also in parallel with the alignment direction of the upper unit 5 and the lower unit 6. Such a rotational drive of the casing 11 around the lower unit rotation axis line S1 is performed by the head oscillation drive motor 10. A gear portion 13 for transmitting the rotation of the electric motor 9 to the propeller 12 is stored in the casing 11.

The propeller 12 includes a boss portion 14 having a cylindrical shape, a propeller shaft 15 that is provided in the boss portion 14 and rotates integrally with the boss portion 14, and a plurality of wing portions 16 that are provided around the boss portion 14. A propeller rotation axis line S2 of the propeller 12 (an axis line of the propeller shaft 15) is orthogonal to the lower unit rotation axis line S1. That is, at the tilt-down position TDp, the propeller rotation axis line S2 is along the horizontal direction.

At the tilt-down position TDp, the propeller 12 is offset further rearward than the lower unit rotation axis line S1. In other words, the position of the wing portion 16 is offset further rearward than the lower unit rotation axis line S1. In the propeller 12, the rotation of the electric motor 9 is transmitted to the propeller shaft 15 via the gear portion 13. Thereby, the propeller 12 is rotated, and a thrust force is generated at the hull 2. The propeller 12 is rotatable forward and backward, and the hull 2 is advanced or retracted depending on the rotation direction of the propeller 12.

Attitude Control Portion

The attitude control portion 4 includes: an inclination angle sensor 21 that detects a tilt-up angle (inclination angle) of the outboard engine 3; and a rotation position sensor 22 that detects the rotation position of the lower unit 6 relative to the upper unit 5 in addition to the bracket 8, the head oscillation drive motor 10, and the hydraulic cylinder 17. The inclination angle sensor 21 is provided, for example, on the base portion 8*a* of the bracket 8.

The inclination angle sensor 21 detects an inclination angle of the base portion 8*a*. An attachment position of the inclination angle sensor 21 is not limited to the base portion 8*a*. For example, the inclination angle sensor 21 may be provided in the cowl 7. In this case, the inclination angle sensor 21 detects an inclination angle of the cowl 7 (outboard engine 3). The inclination angle sensor 21 may have a configuration that detects a tilt-up angle of the outboard engine 3. For example, the tilt-up angle of the outboard engine 3 may be detected by the stroke amount of the hydraulic cylinder 17. Further, for example, when the electric motor is used instead of the hydraulic cylinder 17, the rotation position of a motor shaft of the electric motor may be detected, and the tilt-up angle may be obtained based on this detection result.

Here, by the tilt-up angle changing, the inclination angle of the propeller rotation axis line S2 also changes. That is, the inclination angle sensor 21 detects the inclination angle of the propeller rotation axis line S2.

A detection result of the inclination angle sensor 21 is output as a signal to the outboard engine control portion 20. The outboard engine control portion 20 performs a drive control of the hydraulic cylinder 17 on the basis of the detection result of the inclination angle sensor 21. Thereby, the tilt-up angle (the inclination angle of the propeller rotation axis line S2) of the outboard engine 3 is controlled.

The rotation position sensor 22 detects a rotation position of the motor shaft (not shown) of the head oscillation drive motor 10. However, the rotation position sensor 22 is not limited thereto as long as the rotation position of the lower unit 6 relative to the upper unit 5 can be detected.

Here, the angle (direction) of the propeller rotation axis line S2 also changes by the casing 11 rotating around the lower unit rotation axis line S1. That is, the rotation position sensor 22 detects the inclination angle of the propeller rotation axis line S2.

A detection result of the rotation position sensor 22 is output as a signal to the outboard engine control portion 20. The outboard engine control portion 20 performs a drive control of the head oscillation drive motor 10 on the basis of the detection result of the rotation position sensor 22. Thereby, the rotation position (the inclination angle of the propeller rotation axis line S2) of the lower unit 6 is controlled.

Shake Detection Sensor

The shake detection sensor 19 is provided on the hull 2. For example, a gyro sensor that detects an angular speed of the hull 2 is used as the shake detection sensor 19. A detection result of the shake detection sensor 19 is output as a signal to the outboard engine control portion 20. The outboard engine control portion 20 obtains an inclination angle of the hull 2 on the basis of the detection result of the shake detection sensor 19 and performs an overall drive control of the motors 9, 10 and the hydraulic cylinder 17. Thereby, shaking and movement at the time of anchorage of the hull 2 is prevented. Hereinafter, an operation of the hull attitude control apparatus 1 is specifically described.

Operation of Hull Attitude Control Apparatus

First, the hull 2 is set to an anchorage mode from an operation mode. The operation mode is a mode in which an ignition switch is turned on, and the marine vessel 100 is set to be operable. In the operation mode, the outboard engine 3 is at the tilt-down position TDp. At the tilt-down position TDp, by driving the propeller 12 (the propeller drive motor 9) or performing a head oscillation of the lower unit 6 (driving the head oscillation drive motor 10), the marine vessel 100 is advanced in a desired direction. The propeller 12 is offset further rearward than the lower unit rotation axis line S1.

The anchorage mode is a mode set when, for example, the propeller 12 (propeller drive motor 9) is stopped, and a predetermined period of time elapses in a state where the outboard engine 3 is at the tilt-down position TDp, and the ignition switch is in an ON state. However, the embodiment is not limited thereto, and the set condition of the anchorage mode is varied. For example, the anchorage mode may be set by stopping the propeller 12 (propeller drive motor 9) and turning on an anchorage mode switch (not shown) that is provided on the hull 2 in a state where the ignition switch is an ON state or the like.

When the mode is set to the anchor mode, the outboard engine 3 is tilted upward by the bracket 8 and the hydraulic cylinder 17 (refer to an arrow Y1 in FIG. 2). Further, the lower unit 6 is rotated by 180° by the head oscillation drive motor 10. That is, the direction is changed such that the position of the propeller 12 (wing portion 16) is located at a further forward position than the lower unit rotation axis line S1. Hereinafter, such 180° rotation of the lower unit 6 is referred to as an inversion of the lower unit 6. In the inversion, it is not necessary to completely rotate by 180° as long as the direction becomes an opposite direction. For example, the rotation of the lower unit 6 by 160° to 200° is also included in the inversion described above. The meaning of the inversion described below is also similar.

At this time, the shake (refer to an arrow Y2 in FIG. 1 and FIG. 2) of the hull 2 is detected by the shake detection sensor 19. The outboard engine control portion 20 performs a drive control of the propeller drive motor 9 on the basis of the detection result of the shake detection sensor 19. That is, the propeller drive motor 9 (propeller 12) is repeatedly rotated forward and backward in response to the shake of the hull 2 so as to prevent shaking of the hull 2.

Then, a thrust force is generated by the propeller 12, the thrust force and a force in the shake direction of the hull 2 cancel each other, and shaking of the hull 2 is prevented. That is, the forward/backward rotation is performed such that the thrust force is generated in a direction opposite to the shake direction of the hull 2. For example, when a bow 2*b* of the hull 2 floats upward (refer to an arrow Y3 in FIG. 1), the thrust force is generated in a direction in which the stern 2*a* floats upward by the propeller 12. Conversely, when the bow 2*b* of the hull 2 sinks (refer to an arrow Y5 in FIG. 1), the thrust force is generated in a direction in which the stern 2*a* sinks by the propeller 12.

Further, it is desirable that the outboard engine control portion 20 changes the thrust force in accordance with the shake speed of the hull 2. That is, the rotation speed of the propeller drive motor 9 (propeller 12) is changed in accordance with the shake speed of the hull 2. Thereby, shaking of the hull 2 is quickly prevented. It is also possible to manually change the rotation speed of the propeller drive motor 9 (propeller 12).

Here, an action by the inversion of the lower unit 6 is described in detail with reference to FIG. 3.

Figure 3:
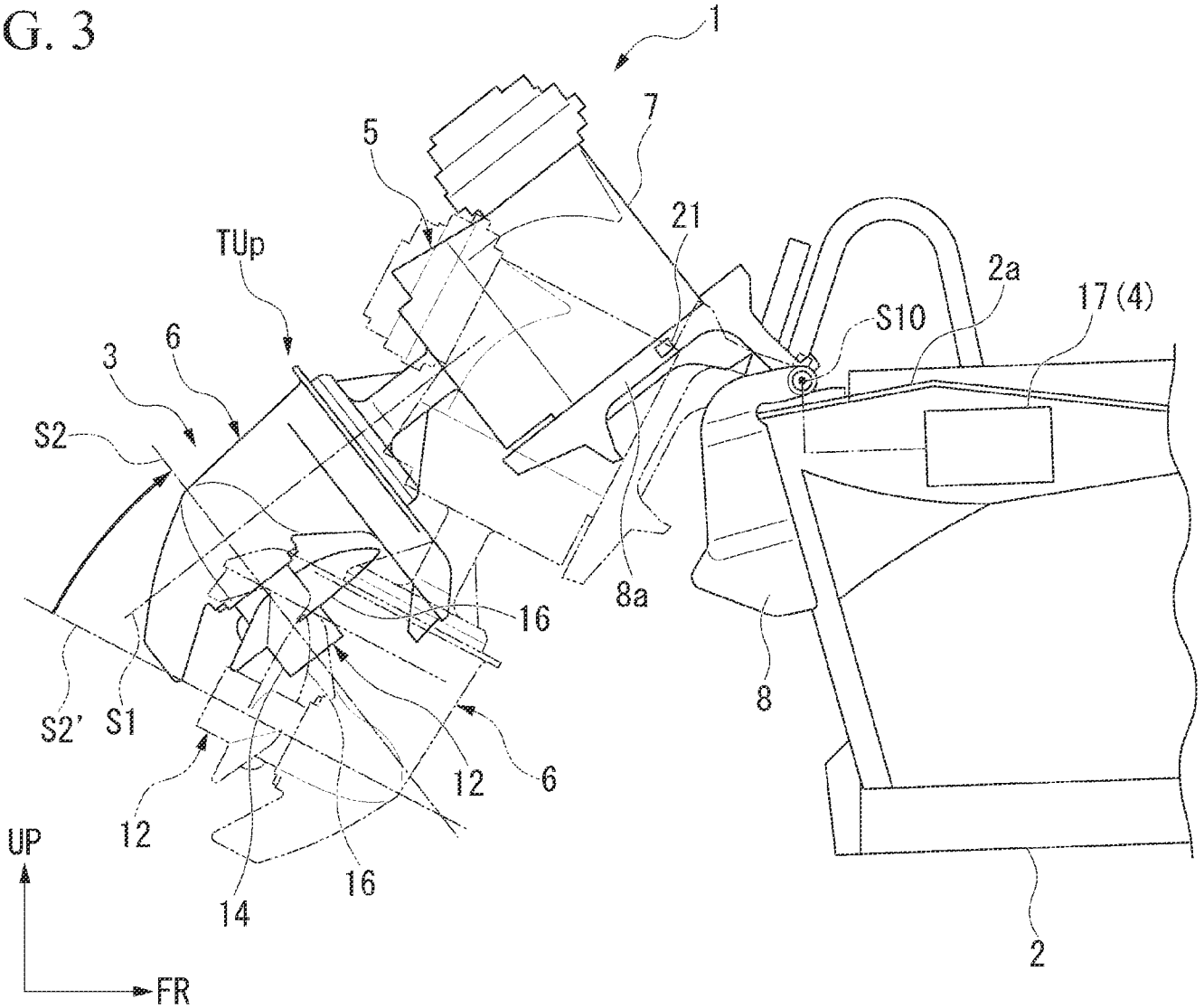
FIG. 3 is a view showing an action of a lower unit at the time of an anchorage mode according to the embodiment of the present invention.

FIG. 3 is a view showing an action of the lower unit 6 at the time of the anchorage mode.

As shown in FIG. 3, when the lower unit 6 is inverted (indicated by a solid line in FIG. 3), the position of the propeller 12 (wing portion 16) is located at a further forward position than the lower unit rotation axis line S1. On the other hand, when the lower unit 6 is not rotated by 180° (indicated by a two-dot chain line in FIG. 3), the position of the propeller 12 (wing portion 16) is located at a further rearward position than the lower unit rotation axis line S1.

Therefore, when the lower unit 6 is rotated by 180°, the wing portion 16 can be submerged in the water even if the tilt-up position TUp is higher compared to a case where the lower unit 6 is not rotated by 180°. The wing portion 16 being submerged in the water is a condition for obtaining a thrust force by the propeller 12.

The propeller rotation axis line S2 when the tilt-up position TUp is high is closer to (along) the upward-downward direction compared to a propeller rotation axis line S2' when the tilt-up position TUp is low. That is, the thrust force generated by the propeller 12 can be aligned along the upward-downward direction as much as possible. As a result, shaking of the hull 2 can be efficiently prevented by the thrust force of the propeller 12.

In this way, the hull attitude control apparatus 1 described above includes the outboard engine 3, the attitude control portion 4, the outboard engine control portion 20, and the shake detection sensor 19. In the anchorage mode, the propeller rotation axis line S2 is in a state of being inclined relative to the horizontal direction by the attitude control portion 4, that is, the outboard engine 3 is in a tilt-up state. Further, the outboard engine control portion 20 performs a drive control of the propeller drive motor 9 on the basis of the detection result of the shake detection sensor 19. Therefore, shaking of the hull 2 can be prevented by using the outboard engine 3. Therefore, an additional mechanism for preventing shaking of the hull 2 as in the related art is not required, and it is possible to prevent shaking of the hull 2 while minimizing the increase of manufacturing costs and the weight of the hull attitude control apparatus 1 as much as possible.

Since it is possible to minimize the increase of manufacturing costs and the weight of the hull attitude control apparatus 1 as much as possible, it is possible to contribute to the improvement of the energy efficiency.

In order to prevent shaking of the hull 2 by the outboard engine 3, a control is performed such that the thrust force is generated in a direction opposite to the shake direction of the hull 2. Therefore, it is possible to reliably and efficiently prevent shaking of the hull, and it is possible to contribute to the improvement of the energy efficiency.

Further, the propeller drive motor 9 (propeller 12) is repeatedly rotated forward and backward in accordance with shaking of the hull 2. Therefore, it is possible to further quickly and continuously prevent shaking of the hull 2.

When the thrust force is changed in accordance with a shake speed of the hull 2, it is possible to further quickly prevent shaking of the hull 2. In this case, the rotation speed of the propeller drive motor 9 (propeller 12) is changed in accordance with the shake speed of the hull 2.

The lower unit 6 of the outboard engine 3 is provided to be rotatable around the lower unit rotation axis line S1 relative to the upper unit 5. The propeller 12 is offset rearward relative to the lower unit rotation axis line S1 at the tilt-down position TDp. When the outboard engine 3 is tilted upward in the anchorage mode, the lower unit 6 is rotated by 180° from the attitude of the operation mode (at the time of traveling).

Therefore, the tilt-up position TUp can be positioned as high as possible in a range in which the propeller 12 (wing portion 16) can be submerged in water. As a result, the thrust force generated by the propeller 12 can be aligned along the upward-downward direction as much as possible. Therefore, shaking of the hull 2 can be efficiently prevented by the thrust force of the propeller 12, and it is possible to contribute to the improvement of energy efficiency.

Modification Example

Next, modification examples of a hull attitude control apparatus 1 are described.

The above embodiment is described using a case in which shaking of the hull 2 is prevented by rotating the propeller drive motor 9 (propeller 12) forward and backward. However, the embodiment is not limited thereto, and shaking of the hull 2 may be prevented by repeatedly rotating and stopping the propeller drive motor 9 (propeller 12). In this case, the rotation of the propeller drive motor 9 (propeller 12) may be only at least one of forward rotation and backward rotation. Even in such a configuration, it is possible to achieve effects similar to that of the embodiment described above.

The above embodiment is described using a case in which shaking of the hull 2 is detected by the shake detection sensor 19 provided on the hull 2. However, the embodiment is not limited thereto, and it is sufficient that the shake detection sensor 19 is able to detect shaking of the hull 2 as a result. For example, the outboard engine 3 described above is integral with the hull 2. In a structure in which the outboard engine 3 is integral with the hull 2, and the hull 2 and the outboard engine 3 are integrally shaken, the shake of the outboard engine 3 may be detected. Shaking of the outboard engine 3 may be regarded as shaking of the hull 2. In such a case, detecting the shake or the movement of the outboard engine 3 is synonymous with detecting shaking or movement of the hull 2. In such a case, for example, the shake detection sensor 19 may be provided on the outboard engine 3.

The above embodiment is described using a case in which the hull attitude control apparatus 1 includes the shake detection sensor 19 that detects shaking of the hull 2. However, the embodiment is not limited thereto, and the hull attitude control apparatus 1 may include a positioning sensor 23 (refer to FIG. 1) that detects the position of the hull 2.

The positioning sensor 23 is a sensor capable of detecting a self-position (positioning information including the latitude and the longitude) by a satellite positioning system (positioning satellite) such as a D-GPS, a GPS, a GLONASS, Hokuto, Galileo, or Michibiki. That is, the positioning sensor 23 receives a satellite signal (a position of the positioning satellite, a transmission time, correction information, and the like) that is transmitted from the positioning satellite and detects the position (for example, the latitude and the longitude) of the hull 2 on the basis of the satellite signal. According to such a positioning sensor 23, it is possible to detect a case in which the hull 2 moves by receiving the influence of waves, wind, or the like in spite of the anchorage mode.

When the movement of the hull 2 is detected, the hull attitude control apparatus 1 may prevent the movement of the hull 2 in addition to preventing shaking of the hull 2. In a case where the movement of the hull 2 is prevented, a control of the tilt-up angle of the outboard engine 3 is performed by the hydraulic cylinder 17, and a head oscillation (driving of the head oscillation drive motor 10) of the lower unit 6 is performed in accordance with the movement direction of the hull 2. Then, a thrust force is generated in a direction opposite to the movement direction of the hull 2 by the propeller 12, and the movement of the hull 2 is prevented.

Further, the drive direction of the lower unit 6 may be only one direction relative to the shake. In this case, the propeller 12 is driven at a time when the thrust force acts in a direction of preventing shaking of the hull 2. The movement of the hull 2 may be prevented by such a method.

Further, by performing the head oscillation control of the lower unit 6 or the drive control of the propeller 12 while maintaining the tilt-down position TDp, the movement of the hull 2 can be prevented.

Further, by changing the tilt-up angle of the outboard engine 3, a load in the direction of preventing shaking of the hull 2 can be differentiated. As a result, a thrust force in a direction of preventing the movement of the hull 2 also changes. Thereby, the movement of the hull 2 may be prevented.

Further, at this time, it is desirable that the outboard engine control portion 20 change the thrust force in accordance with the movement speed of the hull 2 and determine the drive time of the propeller 12. By such a configuration, the hull 2 can be efficiently stopped at a position. Therefore, it is possible to contribute to the improvement of the energy efficiency.

In this way, the control of the inclination angle of the propeller rotation axis line S2 by the attitude control portion 4 includes not only the control of the inclination angle relative to the horizontal direction by the tilt-up but also the control of the inclination angle (head oscillation angle) relative to the forward-rearward direction of the hull 2.

Figure 4:
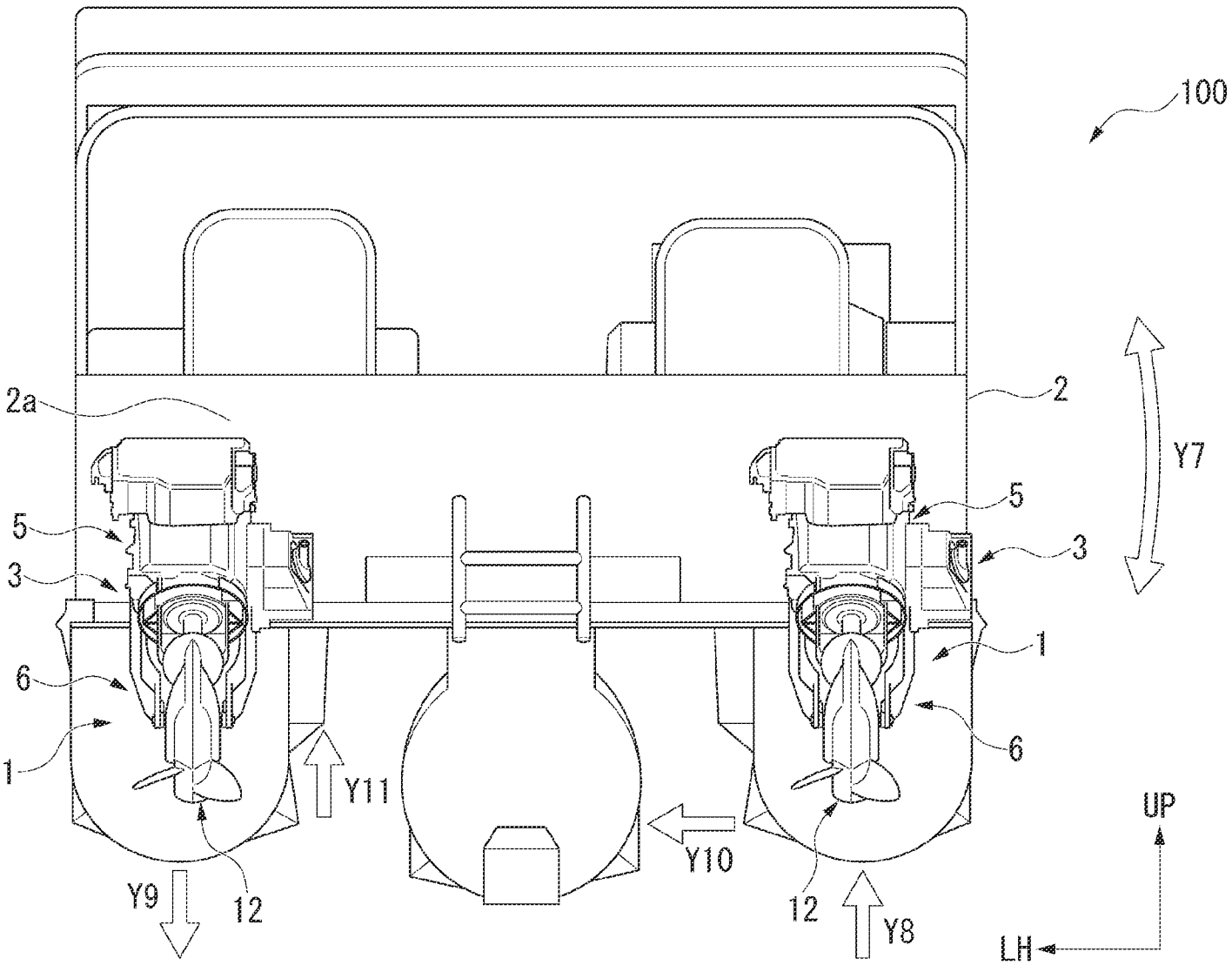
FIG. 4 is a plan view of a modification example of the marine vessel according to the embodiment of the present invention when seen from a stern side.

FIG. 4 is a plan view of a modification example of the marine vessel 100 when seen from the stern 2*a* side of the hull 2.

The above embodiment is described using a case in which the hull attitude control apparatus 1 includes one outboard engine 3 that is provided on the stern 2*a* of hull 2. However, the embodiment is not limited thereto. As shown in FIG. 4, the hull attitude control apparatus 1 may include two outboard engines 3 that are provided on the stern 2*a* of the hull 2.

The outboard engine 3 is arranged on both sides in the width direction of the hull 2. FIG. 4 shows a tilt-up state of each outboard engine 3.

In such a configuration, for example, when the hull 2 is subject to a horizontal shake (rolling) (refer to an arrow Y7 in FIG. 4), by using the propeller 12 of each outboard engine 3, shaking of the hull 2 can be quickly prevented. Since two outboard engines 3 are provided, it is possible to quickly prevent various shaking and movement such as a vertical shake (pitching) of the hull 2 in addition to the horizontal shake.

Further, for example, the propellers 12 of the outboard engines 3 may be rotated in a direction opposite to each other, and thrust forces in a direction opposite to each other may be generated (for example, refer to arrows Y8 and Y9 in FIG. 4). Further, only one of the outboard engines 3 may be driven, and shaking of the hull 2 may be prevented. Further, one of the outboard engines 3 may be used for preventing the movement of the hull 2 (for example, refer to an arrow Y10 in FIG. 4), and the other of the outboard engines 3 may be used for preventing shaking of the hull 2 (for example, refer to an arrow Y11 in FIG. 4). In this case, the outboard engine 3 used for preventing the movement of the hull 2 may not be tilted upward, but only the outboard engine 3 used for preventing shaking of the hull 2 may be tilted upward.

Figure 5:
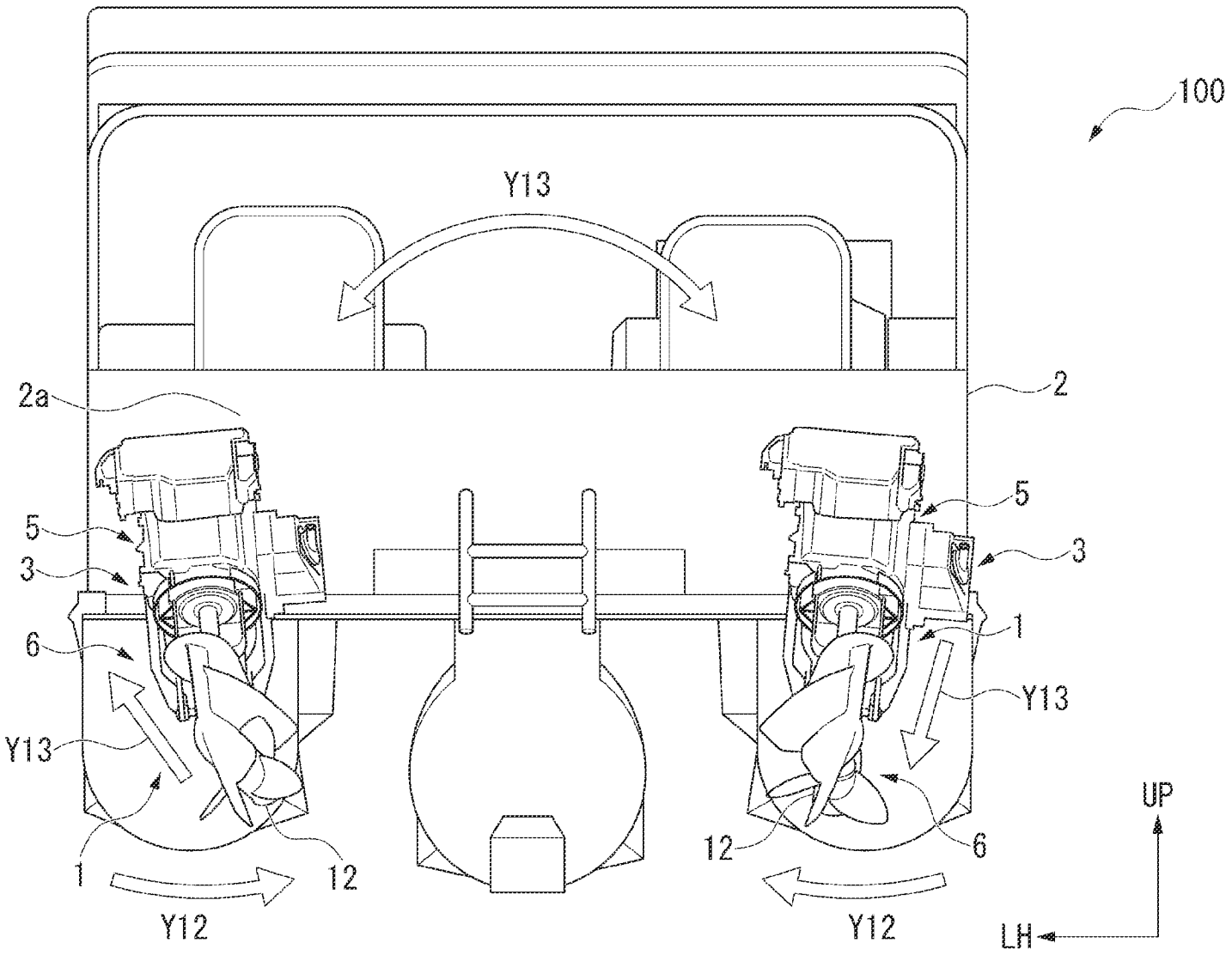
FIG. 5 is a plan view of another modification example of the marine vessel according to the embodiment of the present invention when seen from the stern side.

FIG. 5 is a plan view of another modification example of the marine vessel 100 when seen from the stern 2*a* side of the hull 2.

The above embodiment is described using a case in which the outboard engine 3 is tilted in the upward-downward direction so as to rotate around the rotation axis line S10 parallel to the width direction of the hull 2 by the bracket 8 and the hydraulic cylinder 17. However, the embodiment is not limited thereto. As shown in FIG. 5, the bracket 8 and the hydraulic cylinder 17 may not only tilt the outboard engine 3 in the upward-downward direction but also tilt the outboard engine 3 relative to the upward-downward direction (for example, refer to arrows Y12 in FIG. 5).

In such a case, even when the lower unit 6 is only inverted, the propeller 12 of each outboard engine 3 can generate not only a thrust force in the upward-downward direction but also a thrust force in a lateral direction that intersects the upward-downward direction. Therefore, both of the two outboard engines 3 can have a role of preventing shaking of the hull 2 and a role of preventing the movement of the hull 2 (refer to arrows Y13 in FIG. 5).

The above embodiment is described using a case in which shaking or movement of the hull 2 is prevented by rotating the propeller 12 (propeller drive motor 9) forward and backward or by changing the rotation speed of the propeller 12 (propeller drive motor 9). However, the embodiment is not limited thereto. Shaking or movement of the hull 2 may be prevented by setting the rotation of the propeller 12 (propeller drive motor 9) to be constant and controlling only the inclination angle of the propeller rotation axis line S2.

The above embodiment is described using a case in which the propeller rotation axis line S2 is inclined relative to the horizontal direction by tilting the outboard engine 3 by the hydraulic cylinder 17 and the bracket 8. However, the embodiment is not limited thereto. The upper unit 5 of the outboard engine 3 may be fixed, and the lower unit 6 may be provided to be tiltable in the upward-downward direction relative to the upper unit 5 and to be capable of performing the head oscillation in the horizontal direction. That is, it is sufficient that only the inclination angle of the propeller rotation axis line S2 can be controlled while the lower unit rotation axis line S1 is fixed along the upward-downward direction.

The above embodiment and modification examples are described using a case in which the hull attitude control apparatus 1 includes the shake detection sensor 19 or the positioning sensor 23 in order to detect the state (shake or movement) of the hull 2. The shake detection sensor 19 is described using an example in which a gyro sensor that detects an angular speed of the hull 2 is used as the shake detection sensor 19. A case is described in which the positioning sensor 23 is a sensor capable of detecting a self-position (positioning information including the latitude and the longitude) by a satellite positioning system (positioning satellite) such as a D-GPS, a GPS, a GLONASS, Hokuto, Galileo, or Michibiki. However, the embodiment is not limited thereto. The hull attitude control apparatus 1 may include a sensor capable of detecting or predicting the state of the hull 2. Examples of such a sensor include the following sensor.

Figure 6:
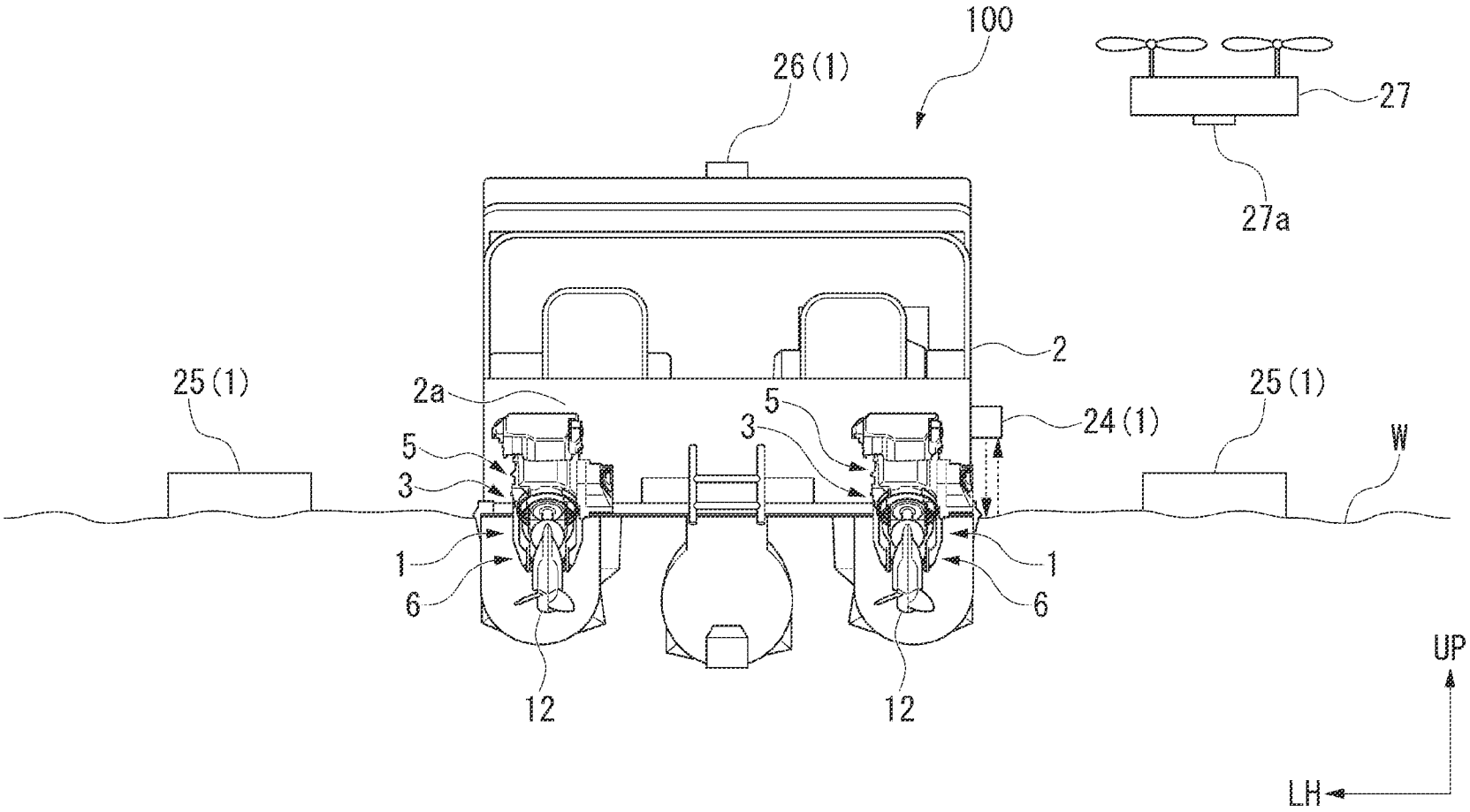
FIG. 6 is a view showing an example of a sensor that detects or predicts the state of a hull according to the embodiment of the present invention.

FIG. 6 is a view showing an example of a sensor that detects or predicts the state of the hull 2 in place of the shake detection sensor 19 or the positioning sensor 23.

As shown in FIG. 6, the hull attitude control apparatus 1 may include a distance sensor 24 in order to detect the state of the hull 2. The distance sensor 24 is attached, for example, to a side surface (a starboard side, a portside) of the hull 2.

The distance sensor 24 detects a distance to a water surface W from a position at which the distance sensor 24 is attached. The distance detected by the distance sensor 24 is output as a signal to the outboard engine control portion 20 (refer to FIG. 1). The outboard engine control portion 20 obtains shaking of the hull 2 on the basis of the change of the distance to the water surface W detected by the distance sensor 24 and performs an overall drive control of the motors 9, 10 and the hydraulic cylinder 17.

The hull attitude control apparatus 1 may include a plurality of buoys 25 that float around the hull 2 and a buoy detection sensor 26 that detects the position and the height of each buoy 25 in order to detect the state of the hull 2. As a detection method of each buoy 25 by the buoy detection sensor 26, for example, a transmitter (not shown) may be provided on the buoy 25, and a receiver that receives a signal that is output from the buoy 25 may be provided on the buoy detection sensor 26. Further, as the buoy detection sensor 26, a camera that images the buoy 25 may be provided. The position and the height of each buoy 25 may be detected based on an image captured by the camera.

The position and the height of each buoy 25 detected by the buoy detection sensor 26 are output as a signal to the outboard engine control portion 20. The outboard engine control portion 20 obtains a shape of wave around the hull 2 on the basis of the position and the height of each buoy 25 and predicts the shake and the movement of the hull 2 on the basis of the shape of wave. The outboard engine control portion 20 performs an overall drive control of the motors 9, 10 and the hydraulic cylinder 17 on the basis of the predicted shake of the hull 2.

The hull attitude control apparatus 1 may include a small flight vehicle (drone) 27 in order to detect the state of the hull 2. The small flight vehicle 27 includes a sensor 27*a* that detects shaking and movement of the hull 2. As the sensor 27*a*, for example, a camera is used. Shaking and movement of the hull 2 detected by the small flight vehicle 27 is output as a signal to the outboard engine control portion 20. The outboard engine control portion 20 performs an overall drive control of the motors 9, 10 and the hydraulic cylinder 17 on the basis of the shake and the movement of the hull 2.

Figure 7:
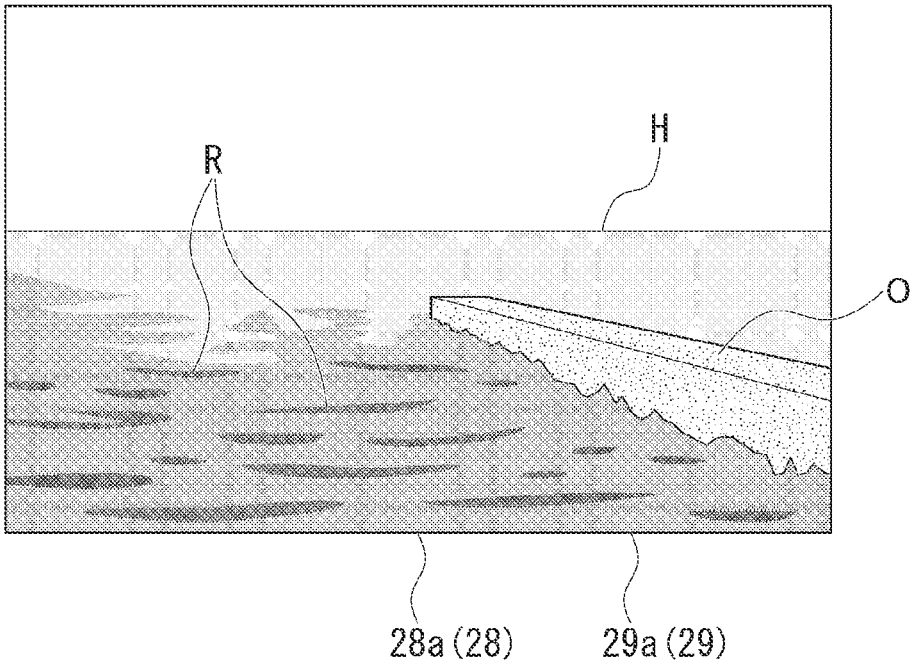
FIG. 7 is a view showing another example of a sensor that detects or predicts the state of a hull according to the embodiment of the present invention.

FIG. 7 is a view showing another example of a sensor that detects or predicts the state of the hull 2 in place of the shake detection sensor 19 or the positioning sensor 23.

As shown in FIG. 7, the hull attitude control apparatus 1 may include a wave camera 28 that images a wave R around the hull 2 and an object camera 29 that images an object (for example, a rock, a pier, or the like) 0 around the hull 2 in order to detect the state (shape) of the hull 2. FIG. 7 shows an image captured by the wave camera 28 or the object camera 29.

The state of the wave R around the hull 2 imaged by the wave camera 28 is output as a signal to the outboard engine control portion 20. The outboard engine control portion 20 predicts the shake and the movement of the hull 2 on the basis of the state of the wave R and performs an overall drive control of the motors 9, 10 and the hydraulic cylinder 17.

When the object camera 29 is used, by using a horizontal line H or a surrounding object O as a reference, shaking and movement of the hull 2 is detected based on the change of the position of the horizontal line H or the object O. The outboard engine control portion 20 performs an overall drive control of the motors 9, 10 and the hydraulic cylinder 17 on the basis of shaking and movement of the hull 2 obtained from an image captured by the object camera 29. The object camera 29 may be the camera for detecting the buoy 25 described above. One camera may have a function of two cameras 28, 29 which are the wave camera 28 and the object camera 29.

The present invention is not limited to the embodiment described above and includes various modifications of the embodiment described above without departing from the scope of the present invention. For example, the embodiment and various modification examples described above may be used in combination.

DESCRIPTION OF REFERENCE NUMERALS

1 Hull attitude control apparatus
2 Hull
3 Outboard engine
4 Attitude control portion
5 Upper unit
6 Lower unit
9 Propeller drive motor (electric motor)
12 Propeller
19 Shake detection sensor (state detection sensor, tilt angle sensor)
20 Outboard engine control portion (motor control portion)
21 Inclination angle sensor (inclination angle control portion)
22 Rotation position sensor (inclination angle control portion)
23 Positioning sensor (state detection sensor)
24 Distance sensor
25 Buoy
26 Buoy detection sensor
27 Small flight vehicle
28 Wave camera
29 Object camera
H Horizontal line
O Object
R Wave
S1 Lower unit rotation axis line
S2 Propeller rotation axis line
TDp Tilt-down position
TUp Tilt-up position

What is claimed is:

1. A hull attitude control apparatus comprising:

an outboard engine that comprises a propeller which is provided on a hull and generates a thrust force at the hull and an electric motor which drives the propeller;

an inclination angle control portion that controls an inclination angle of a propeller rotation axis line in the propeller;

a motor control portion that performs a drive control of the electric motor; and a state detection sensor that detects or predicts at least one of shaking or movement of the hull, wherein the inclination angle control portion and the motor control portion perform a control of the propeller so as to prevent the at least one of shaking or movement of the hull based on a detection result or a prediction result of the state detection sensor, the state detection sensor detects or predicts the shaking of the hull, and the motor control portion repeatedly rotates the electric motor forward and backward in accordance with the shaking of the hull.

2. The hull attitude control apparatus according to claim 1, wherein the motor control portion performs the control of the propeller in a state where the propeller rotation axis line is inclined relative to a horizontal direction by the inclination angle control portion.

3. The hull attitude control apparatus according to claim 1, wherein the motor control portion performs the drive control of the electric motor so as to generate the thrust force in a direction opposite to a direction of the shaking or a direction of the movement of the hull.

4. The hull attitude control apparatus according to claim 1, wherein the motor control portion changes the thrust force in accordance with a speed of the shaking or a speed of the movement of the hull.

5. The hull attitude control apparatus according to claim 1, wherein the state detection sensor detects or predicts the movement of the hull, and in an anchorage state of the hull, the inclination angle control portion and the motor control portion rotate the electric motor forward and backward so as to generate a thrust force in a direction opposite to a direction of the movement of the hull, and the motor control portion determines a drive time of the electric motor so as to stop the hull at a place.

6. The hull attitude control apparatus according to claim 5, wherein the outboard engine comprises, at a tilt-down position, an upper unit on which the electric motor is provided and which is arranged at an upper portion and a lower unit on which the propeller is provided and which is arranged at a lower portion of the upper unit, the lower unit is provided to be rotatable relative to the upper unit around a lower unit rotation axis line that is in parallel with an alignment direction of the upper unit and the lower unit, and a thrust force is generated in a direction opposite to the direction of the movement of the hull by rotating the lower unit relative to the upper unit.

7. The hull attitude control apparatus according to claim 2, wherein the outboard engine comprises, at a tilt-down position, an upper unit on which the electric motor is provided and which is arranged at an upper portion and a lower unit on which the propeller is provided and which is arranged at a lower portion of the upper unit, the lower unit is provided to be rotatable relative to the upper unit around a lower unit rotation axis line that is in parallel with an alignment direction of the upper unit and the lower unit, the propeller is provided at the tilt-down position so as to be offset rearward relative to the lower unit rotation axis line, and when the propeller rotation axis line is inclined relative to a horizontal direction by the inclination angle control portion, in a state where the propeller is inverted around the lower unit rotation axis line from an attitude at a time of traveling of the hull, the outboard engine is inclined to a tilt-up position.

8. The hull attitude control apparatus according to claim 1, wherein the inclination angle control portion controls an inclination angle of the propeller rotation axis line by controlling a tilt-up angle of the outboard engine.

9. The hull attitude control apparatus according to claim 1, wherein the state detection sensor comprises a tilt angle sensor that is provided on the hull and detects a tilt of the hull, and the shaking of the hull is detected based on a detection result of the tilt angle sensor.

10. The hull attitude control apparatus according to claim 1, wherein the state detection sensor comprises at least one of:

a distance sensor that is provided on the hull and detects a distance from an arrangement position to a water surface, and the shaking of the hull is detected based on a change of the distance detected by the distance sensor, an object camera that images an object around the hull or a horizontal line as a reference, and at least one of shaking or movement of the hull is detected based on a shake of the object or of the horizontal line imaged by the object camera or by a change of a distance to the object, or a small flight vehicle that detects an attitude of the hull, and at least one of shaking or movement of the hull is detected based on a detection result from the small flight vehicle.

11. The hull attitude control apparatus according to claim 1, wherein the state detection sensor comprises at least one of:

a plurality of buoys that float around the hull and a buoy detection sensor that detects a position of each of the plurality of buoys, a state of a wave around the hull is obtained based on a detection result of the buoy detection sensor, and at least one of shaking or movement of the hull is predicted based on the state of the wave, or a wave camera that images a wave around the hull, and at least one of shaking or movement of the hull is predicted based on a state of the wave imaged by the wave camera.

12. A hull attitude control apparatus comprising:

an outboard engine that comprises a propeller, which is provided on a hull and generates a thrust force at the hull, and an electric motor, which drives the propeller;

an inclination angle control portion that controls an inclination angle of a propeller rotation axis line in the propeller;

a motor control portion that performs a drive control of the electric motor; and a state detection sensor that detects or predicts at least one of shaking or movement of the hull, wherein the inclination angle control portion and the motor control portion perform a control of the propeller so as to prevent the at least one of shaking or movement of the hull based on a detection result or a prediction result of the state detection sensor, the state detection sensor detects or predicts the movement of the hull, and in an anchorage state of the hull, the motor control portion rotates the electric motor forward and backward so as to generate a thrust force in a direction opposite to a direction of the movement of the hull, and the motor control portion determines a drive time of the electric motor so as to stop the hull at a place.

13. A hull attitude control apparatus comprising:

an outboard engine that comprises a propeller, which is provided on a hull and generates a thrust force at the hull, and an electric motor, which drives the propeller;

an inclination angle control portion that controls an inclination angle of a propeller rotation axis line in the propeller;

a motor control portion that performs a drive control of the electric motor; and a state detection sensor that detects or predicts at least one of shaking or movement of the hull, wherein the inclination angle control portion and the motor control portion perform a control of the propeller so as to prevent the at least one of shaking or movement of the hull based on a detection result or a prediction result of the state detection sensor, the state detection sensor comprises a distance sensor that is provided on the hull and detects a distance from an arrangement position to a water surface, and the shaking of the hull is detected based on a change of the distance detected by the distance sensor.

14. A hull attitude control apparatus comprising:

an outboard engine that comprises a propeller which is provided on a hull and generates a thrust force at the hull and an electric motor which drives the propeller;

an inclination angle control portion that controls an inclination angle of a propeller rotation axis line in the propeller;

a motor control portion that performs a drive control of the electric motor; and a state detection sensor that detects or predicts at least one of shaking or movement of the hull, wherein the inclination angle control portion and the motor control portion perform a control of the propeller so as to prevent the at least one of shaking or movement of the hull based on a detection result or a prediction result of the state detection sensor, the state detection sensor comprises:

a plurality of buoys that float around the hull, and a buoy detection sensor that detects a position of each of the plurality of buoys, a state of a wave around the hull is obtained based on a detection result of the buoy detection sensor, and the at least one of shaking or movement of the hull is predicted based on the state of the wave.

15. A hull attitude control apparatus comprising:

an outboard engine that comprises a propeller, which is provided on a hull and generates a thrust force at the hull, and an electric motor which drives the propeller;

an inclination angle control portion that controls an inclination angle of a propeller rotation axis line in the propeller;

a motor control portion that performs a drive control of the electric motor; and a state detection sensor that detects or predicts at least one of shaking or movement of the hull, wherein the inclination angle control portion and the motor control portion perform a control of the propeller so as to prevent the at least one of shaking or movement of the hull based on a detection result or a prediction result of the state detection sensor, the state detection sensor comprises a wave camera that images a wave around the hull, and the at least one of shaking or movement of the hull is predicted based on a state of the wave imaged by the wave camera.

16. A hull attitude control apparatus comprising:

an outboard engine that comprises a propeller which is provided on a hull and generates a thrust force at the hull and an electric motor which drives the propeller;

an inclination angle control portion that controls an inclination angle of a propeller rotation axis line in the propeller;

a motor control portion that performs a drive control of the electric motor; and a state detection sensor that detects or predicts at least one of shaking or movement of the hull, wherein the inclination angle control portion and the motor control portion perform a control of the propeller so as to prevent the at least one of shaking or movement of the hull based on a detection result or a prediction result of the state detection sensor, the state detection sensor comprises an object camera that images an object around the hull or a horizontal line as a reference, and the at least one of shaking or movement of the hull is detected based on a shake of the object or of the horizontal line imaged by the object camera or by a change of a distance to the object.

17. A hull attitude control apparatus comprising:

an outboard engine that comprises a propeller which is provided on a hull and generates a thrust force at the hull and an electric motor which drives the propeller;

an inclination angle control portion that controls an inclination angle of a propeller rotation axis line in the propeller;

a motor control portion that performs a drive control of the electric motor; and a state detection sensor that detects or predicts at least one of shaking or movement of the hull, wherein the inclination angle control portion and the motor control portion perform a control of the propeller so as to prevent the at least one of shaking or movement of the hull based on a detection result or a prediction result of the state detection sensor, the state detection sensor comprises a small flight vehicle that detects an attitude of the hull, and the at least one of shaking or movement of the hull is detected based on a detection result from the small flight vehicle.

18. A hull attitude control method comprising:

generating a thrust force at a hull by an outboard engine that comprises a propeller which is provided on the hull;

driving the propeller by an electric motor;

controlling an inclination angle of a propeller rotation axis line in the propeller;

performing a drive control of the electric motor; and detecting or predicting at least one of shaking or movement of the hull, wherein the hull attitude control method further comprises: performing a control of the propeller so as to prevent the at least one of shaking or movement of the hull based on a detection result or a prediction result acquired in the detecting or the predicting, the detecting or the predicting is of the shaking of the hull, and the performing of the drive control comprises repeatedly rotating the electric motor forward and backward in accordance with the shaking of the hull.

19. A computer program product facilitating hull attitude control, the computer program product comprising a computer readable storage medium having program instructions embodied therewith, the program instructions executable by a processor to cause the processor to perform the hull attitude control method of claim 18.

20. A hull attitude control method comprising:

generating a thrust force at a hull by an outboard engine that comprises a propeller which is provided on the hull;

driving the propeller by an electric motor;

controlling an inclination angle of a propeller rotation axis line in the propeller;

performing a drive control of the electric motor; and detecting or predicting at least one of shaking or movement of the hull, wherein the hull attitude control method further comprises: performing a control of the propeller so as to prevent the at least one of shaking or movement of the hull based on a detection result or a prediction result acquired in the detecting or the predicting, the detecting or the predicting is of the movement of the hull, and in an anchorage state of the hull, the performing of the drive control comprises:

rotating the electric motor forward and backward so as to generate a thrust force in a direction opposite to a direction of the movement of the hull, and determining a drive time of the electric motor so as to stop the hull at a place.

21. A computer program product facilitating hull attitude control, the computer program product comprising a computer readable storage medium having program instructions embodied therewith, the program instructions executable by a processor to cause the processor to perform the hull attitude control method of claim 20.

22. A hull attitude control method comprising:

generating a thrust force at a hull by an outboard engine that comprises a propeller which is provided on the hull;

driving the propeller by an electric motor;

controlling an inclination angle of a propeller rotation axis line in the propeller;

performing a drive control of the electric motor; and detecting or predicting at least one of shaking or movement of the hull, wherein the hull attitude control method further comprises:

performing a control of the propeller so as to prevent the at least one of shaking or movement of the hull based on a detection result or a prediction result acquired in the detecting or the predicting; and detecting a distance from an arrangement position to a water surface by a distance sensor that is provided on the hull, and the detecting or the predicting comprises detecting the shaking of the hull based on a change of the distance detected by the distance sensor.

23. A computer program product facilitating hull attitude control, the computer program product comprising a computer readable storage medium having program instructions embodied therewith, the program instructions executable by a processor to cause the processor to perform the hull attitude control method of claim 22.

24. A hull attitude control method comprising:

generating a thrust force at a hull by an outboard engine that comprises a propeller which is provided on the hull;

driving the propeller by an electric motor;

controlling an inclination angle of a propeller rotation axis line in the propeller;

performing a drive control of the electric motor; and detecting or predicting at least one of shaking or movement of the hull, wherein the hull attitude control method further comprises:

performing a control of the propeller so as to prevent the at least one of shaking or movement of the hull based on a detection result or a prediction result acquired in the detecting or the predicting;

detecting a position of each of a plurality of buoys that float around the hull by a buoy detection sensor; and obtaining a state of a wave around the hull based on a detection result of the buoy detection sensor, and the detecting or the predicting comprises predicting the at least one of shaking or movement of the hull based on the state of the wave.

25. A computer program product facilitating hull attitude control, the computer program product comprising a computer readable storage medium having program instructions embodied therewith, the program instructions executable by a processor to cause the processor to perform the hull attitude control method of claim 24.

26. A hull attitude control method comprising:

generating a thrust force at a hull by an outboard engine that comprises a propeller which is provided on the hull;

driving the propeller by an electric motor;

controlling an inclination angle of a propeller rotation axis line in the propeller;

performing a drive control of the electric motor; and detecting or predicting at least one of shaking or movement of the hull, wherein the hull attitude control method further comprises:

performing a control of the propeller so as to prevent the at least one of shaking or movement of the hull based on a detection result or a prediction result acquired in the detecting or the predicting; and imaging a wave around the hull by a wave camera, and the detecting or the predicting comprises predicting the at least one of shaking or movement of the hull based on a state of the wave imaged by the wave camera.

27. A computer program product facilitating hull attitude control, the computer program product comprising a computer readable storage medium having program instructions embodied therewith, the program instructions executable by a processor to cause the processor to perform the hull attitude control method of claim 26.

28. A hull attitude control method comprising:

generating a thrust force at a hull by an outboard engine that comprises a propeller which is provided on the hull;

driving the propeller by an electric motor;

controlling an inclination angle of a propeller rotation axis line in the propeller;

performing a drive control of the electric motor; and detecting or predicting at least one of shaking or movement of the hull, wherein the hull attitude control method further comprises:

performing a control of the propeller so as to prevent the at least one of shaking or movement of the hull based on a detection result or a prediction result acquired in the detecting or the predicting; and imaging an object around the hull or a horizontal line as a reference by an object camera, the detecting or the predicting comprises detecting the at least one of shaking or movement of the hull based on a shake of the object or of the horizontal line imaged by the object camera or by a change of a distance to the object.

29. A computer program product facilitating hull attitude control, the computer program product comprising a computer readable storage medium having program instructions embodied therewith, the program instructions executable by a processor to cause the processor to perform the hull attitude control method of claim 28.

30. A hull attitude control method comprising:

generating a thrust force at a hull by an outboard engine that comprises a propeller which is provided on the hull;

driving the propeller by an electric motor;

controlling an inclination angle of a propeller rotation axis line in the propeller;

performing a drive control of the electric motor; and detecting or predicting at least one of shaking or movement of the hull, wherein the hull attitude control method further comprises:

performing a control of the propeller so as to prevent the at least one of shaking or movement of the hull based on a detection result or a prediction result acquired in the detecting or the predicting; and detecting an attitude of the hull by a small flight vehicle, and the detecting or the predicting comprises detecting the at least one of shaking or movement of the hull based on a detection result from the small flight vehicle.

31. A computer program product facilitating hull attitude control, the computer program product comprising a computer readable storage medium having program instructions embodied therewith, the program instructions executable by a processor to cause the processor to perform the hull attitude control method of claim 30.

* * * * *